US012037891B2

(12) United States Patent
Leach et al.

(10) Patent No.: US 12,037,891 B2
(45) **Date of Patent: *Jul. 16, 2024**

(54) METHODS FOR ASSESSING THE RELIABILITY OF HYDRAULICALLY-ACTUATED DEVICES AND RELATED SYSTEMS

(71) Applicant: Transocean Innovation Labs Ltd., George Town (KY)

(72) Inventors: Andrew Leach, Houston, TX (US); Matthew Boike, Houston, TX (US); Luis Rafael Pereira, Katy, TX (US)

(73) Assignee: TRANSOCEAN INNOVATION LABS LTD., Grand Cayman (KY)

( * ) Notice: Subject to any disclaimer, the term of this patent is extended or adjusted under 35 U.S.C. 154(b) by 576 days.

This patent is subject to a terminal disclaimer.

(21) Appl. No.: 17/195,196

(22) Filed: Mar. 8, 2021

(65) Prior Publication Data

US 2021/0317737 A1 Oct. 14, 2021

Related U.S. Application Data

(63) Continuation of application No. 15/610,170, filed on May 31, 2017, now Pat. No. 10,941,648.
(Continued)

(51) Int. Cl.
*E21B 47/09* (2012.01)
*E21B 33/035* (2006.01)
(Continued)

(52) U.S. Cl.
CPC ..... *E21B 47/09* (2013.01); *E21B 33/0355* (2013.01); *E21B 33/062* (2013.01);
(Continued)

(58) Field of Classification Search
CPC ..... E21B 47/09; E21B 33/0355
See application file for complete search history.

(56) References Cited

U.S. PATENT DOCUMENTS 5,021,181 A 6/1991 Kanamori
8,893,803 B1 * 11/2014 Lugo ..... E21B 43/013 166/347
(Continued)

FOREIGN PATENT DOCUMENTS

CN 202108810 U 1/2012
CN 103429911 12/2013
(Continued)

OTHER PUBLICATIONS

International Search Report and Written Opinion in International Application No. PCT/US2017/035234 dated Aug. 14, 2017.
(Continued)

*Primary Examiner* — Clayton E. LaBalle
*Assistant Examiner* — Diana Hancock
(74) *Attorney, Agent, or Firm* — Panitch Schwarze Belisario & Nadel LLP

(57) ABSTRACT

This disclosure includes methods for testing hydraulically-actuated devices and related systems. Some hydraulically-actuated devices have a housing defining an interior volume and a piston disposed within the interior volume and dividing the interior volume into a first chamber and a second chamber, where the piston is movable relative to the housing between a maximum first position and a maximum second position in response to pressure differentials between the first and second chambers. Some methods include: (1) moving the piston to the first position by varying pressure within at least one of the first and second chambers such that pressure within the second chamber is higher than pressure within the first chamber; and (2) while the piston remains in the first position: (a) reducing pressure within the second
(Continued)

chamber and/or increasing pressure within the first chamber; and (b) increasing pressure within the second chamber and/or decreasing pressure within the first chamber.

19 Claims, 4 Drawing Sheets

Related U.S. Application Data

(60) Provisional application No. 62/343,446, filed on May 31, 2016.

(51) Int. Cl.

| | |
|---|---|
| ***E21B 33/06*** | (2006.01) |
| ***E21B 33/064*** | (2006.01) |
| ***E21B 47/07*** | (2012.01) |
| *E21B 33/08* | (2006.01) |

(52) U.S. Cl.
CPC ..... *E21B 33/064* (2013.01); *E21B 33/085* (2013.01); *E21B 47/07* (2020.05)

(56) References Cited

U.S. PATENT DOCUMENTS

| | | | | |
|---|---|---|---|---|
| 10,941,648 | B2 * | 3/2021 | Leach | E21B 33/062 |
| 11,105,173 | B2 * | 8/2021 | Leach | E21B 21/10 |
| 2002/0023532 | A1 | 2/2002 | Porter | |
| 2003/0000693 | A1 | 1/2003 | Couren | |
| 2007/0286745 | A1 * | 12/2007 | Chance | B01F 35/714 417/397 |
| 2010/0223923 | A1 | 9/2010 | Grassi | |
| 2012/0073670 | A1 | 3/2012 | Lymberopoulos | |
| 2013/0027651 | A1 | 1/2013 | Meldrim | |
| 2013/0276516 | A1 * | 10/2013 | Tabor | G01M 3/26 73/37 |
| 2013/0333894 | A1 * | 12/2013 | Geiger | E21B 34/04 166/336 |
| 2014/0047271 | A1 | 2/2014 | Gray | |
| 2014/0131049 | A1 * | 5/2014 | Bourgeau | E21B 33/0355 166/363 |
| 2014/0182271 | A1 | 7/2014 | Jannot et al. | |
| 2015/0114660 | A1 * | 4/2015 | Kotrla | F16L 41/021 285/133.21 |
| 2015/0337950 | A1 | 11/2015 | Knoth et al. | |
| 2016/0084271 | A1 | 3/2016 | Gomm et al. | |
| 2016/0215608 | A1 * | 7/2016 | Jaffrey | E21B 33/06 |
| 2016/0327447 | A1 * | 11/2016 | Hilpert | E21B 33/061 |
| 2017/0362929 | A1 | 12/2017 | Leach et al. | |
| 2022/0003112 | A1 * | 1/2022 | Leach | E21B 47/06 |

FOREIGN PATENT DOCUMENTS

| | | | |
|---|---|---|---|
| CN | 103429911 | A | 12/2013 |
| CN | 103939421 | A | 7/2014 |
| CN | 104093995 | A | 10/2014 |
| CN | 104093995 | A | 10/2014 |
| CN | 104395615 | | 3/2015 |
| CN | 104395615 | A | 3/2015 |
| CN | 104632766 | A | 5/2015 |
| CN | 104632766 | A | 5/2015 |

OTHER PUBLICATIONS

Non-Final Office Action issued by The United States Patent and Trademark Office for U.S. Appl. No. 15/610,170, dated Sep. 20, 2018, 10 pages.
Interview Summary record issued by The United States Patent and Trademark Office for U.S. Appl. No. 15/610,170, dated Feb. 25, 2019, 3 pages.
Final Office Action issued by The United States Patent and Trademark Office for U.S. Appl. No. 15/610,170, dated Jun. 13, 2019, 16 pages.
Office Action issued by the Chinese Patent Office for Application No. 201780047551.5, dated Dec. 17, 2019, 23 pages including English translation.
Extended European Search Report issued by the European Patent Office for Application No. 17807404.3, dated Jan. 29, 2020, 7 pages.
Written Opinion issued by the Singapore Patent Office for Application No. 11201810698S, dated Apr. 7, 2020, 8 pages.
Second Office Action issued by the Chinese Patent Office for Application No. 201780047551.5, dated Sep. 29, 2020, 9 pages including English translation.
Office Action issued by the Singapore Patent Office for Application No. 11201810698S, dated Jun. 25, 2021, 5 pages.
Office Action issued Mar. 7, 2022 in Australian Application No. 2017273551.
Office Action issued Nov. 4, 2021 in Brazilian Application No. 112018074767-0.
Extended European Search Report issued Mar. 4, 2022 in European Application No. 21169599.4.
Communication Pursuant to Article 94(3) EPC for European Patent Application No. 21 169 599.4-1002, issued Jun. 29, 2023.
Communication Pursuant to Article 94(3) EPC for European Patent Application No. 21 169 599.4-1002, issued Dec. 7, 2022.

* cited by examiner

METHODS FOR ASSESSING THE RELIABILITY OF HYDRAULICALLY-ACTUATED DEVICES AND RELATED SYSTEMS

CROSS-REFERENCES TO RELATED APPLICATIONS

This application is a continuation of U.S. patent application Ser. No. 15/610,170, filed May 31, 2017, entitled "Methods for Assessing the Reliability of Hydraulically-Actuated Devices and Related Systems," which claims priority to U.S. Provisional Application No. 62/343,446, filed on May 31, 2016 and entitled "Methods for Assessing the Reliability of Hydraulically-Actuated Devices and Related Systems," the contents of each of which is incorporated herein by reference in its entirety.

BACKGROUND

1. Field of Invention

The present invention relates generally to hydraulically-actuated devices, such as hydraulically-actuated devices of blowout preventers, and more specifically, but not by way of limitation, to methods for assessing the reliability of such hydraulically-actuated devices and related systems.

2. Description of Related Art

A blowout preventer (BOP) is a mechanical device, usually installed redundantly in a stack, used to seal, control, and/or monitor an oil and gas well. A BOP typically includes or is associated with a number of components, such as, for example, rams, annulars, accumulators, test valves, kill and/or choke lines and/or valves, riser connectors, hydraulic connectors, and/or the like, many of which may be hydraulically-actuated.

Due at least in part to the magnitude of harm that may result from failure to actuate a BOP, safety or back-up systems are often implemented, such as, for example, deadman and autoshear systems. However, such systems are typically integrated with an existing BOP such that, if the BOP fails, the systems may be unavailable.

Probability of failure on demand (PFD), which typically increases over time, is a measure of the probability that a given system will fail when it is desired to function that system. Testing is an effective way to reduce PFD; however testing of existing BOPs and/or safety or back-up systems may be difficult. For example, to traditionally test an existing BOP and/or safety or back-up system, full functioning of the BOP and/or safety or back-up system may be required, in some instances, necessitating time- and cost-intensive measures, such as the removal of any objects, such as drill pipe, disposed within the wellbore, the disconnection of the lower marine riser package, and/or the like.

Examples of safety or back-up blowout prevention systems are disclosed in (1) U.S. Pat. No. 8,881,829 and U.S. Pub. Nos.: (2) 2012/0001100 and (3) 2012/0085543.

SUMMARY

Some embodiments of the present disclosure can provide for testing of a system that includes a hydraulically-actuated device having a piston movable between maximum first and second positions, in some instances, without requiring full actuation of the hydraulically-actuated device (e.g., movement of the piston to each of the first and second positions), via, for example, being configured for and/or including moving the piston to the first position and, while the piston remains in the first position: (1) reducing a force that acts to urge the piston toward the first position; and (2) increasing a force that acts to urge the piston toward the first position. Such testing may be performed automatically and/or manually to decrease a PFD of a system.

Some embodiments of the present systems are configured as a safety and/or back-up blowout prevention system having increased availability, reliability, fault-tolerance, retrofitability, and/or the like, via, for example, including a hydraulically-actuated device and a (e.g., dedicated) hydraulic pressure source for actuating the hydraulically-actuated device, a (e.g., dedicated) processor, communications channel, and/or the like for controlling the hydraulically-actuated device, and/or the like (e.g., such that the system is independent of other blowout prevention system(s), integration, and thus fault transfer, between the system and other blowout prevention system(s) is minimized, and/or the like).

Some embodiments of the present systems comprise: a hydraulically-actuated device including a housing defining an interior volume and a piston disposed within the interior volume such that the piston divides the interior volume into a first chamber and a second chamber, where the piston is movable relative to the housing to a maximum first position in response to pressure within the second chamber being greater than pressure within the first chamber and to a maximum second position in response to pressure within the first chamber being greater than pressure within the second chamber, a hydraulic pressure source configured to vary pressure within at least one of the first chamber and the second chamber, and a processor configured to control the pressure source to, while the piston is in the first position: (a) decrease pressure within the second chamber and/or increase pressure within the first chamber; and (b) increase pressure within the second chamber and/or decrease pressure within the first chamber. In some systems, the processor is configured to control the pressure source to move the piston to the first position. In some systems, the processor is configured to control the pressure source to move the piston to the second position. In some systems, the hydraulically-actuated device comprises a blowout preventer (BOP).

In some systems, the pressure source comprises a pump. In some systems, the pump comprises a bidirectional pump, and the system is configured such that: rotation of the pump in a first direction decreases pressure within the second chamber and/or increases pressure within the first chamber; and rotation of the pump in a second direction that is opposite the first direction increases pressure within the second chamber and/or decreases pressure within the first chamber.

Some systems comprise a motor coupled to the pump and configured to actuate the pump. In some systems, the motor comprises an electric motor. Some systems comprise a battery coupled to the motor and configured to supply electrical power to the motor. Some systems comprise an electric motor speed controller coupled to the motor and configured to control the motor.

Some systems comprise one or more sensors configured to capture data indicative of: a pressure of hydraulic fluid within the system; a flowrate of hydraulic fluid within the system; a temperature of hydraulic fluid within the system; and/or a position of the piston relative to the housing. Some systems comprise one or more sensors configured to capture data indicative of a speed of the pump. Some systems comprise one or more sensors configured to capture data indicative of: a speed of the motor; a torque output by the motor; and/or and a power output by the motor. Some systems comprise one or more sensors configured to capture data indicative of a voltage supplied to the motor and/or a current supplied to the motor.

Some systems comprise one or more sensors configured to capture data indicative of one or more parameter values, including a pressure of hydraulic fluid within the system, a flowrate of hydraulic fluid within the system, a temperature of hydraulic fluid within the system, and/or a position of the piston relative to the housing. In some systems, the one or more parameter values includes a speed of the pump. In some systems, the one or more parameter values includes a speed of the motor; a torque output by the motor; and/or a power output by the motor. In some systems, the one or more parameter values includes a voltage supplied to the motor and/or a current supplied to the motor.

In some systems, the processor is configured to compare at least one of the one or more parameter values indicated in data captured by the one or more sensors to an expected parameter value. In some systems, the processor is configured to determine if a difference between the parameter value indicated in data captured by the one or more sensors and the expected parameter value exceeds a threshold.

Some systems comprise a reservoir in fluid communication with the pressure source. Some systems comprise a remotely-operated underwater vehicle (ROV) interface in fluid communication with the hydraulically-actuated device.

Some embodiments of the present methods comprise coupling an embodiment of the present systems to a BOP stack.

Some embodiments of the present methods for testing a hydraulically-actuated device having a housing defining an interior volume and a piston disposed within the interior volume such that the piston divides the interior volume into a first chamber and a second chamber, where the piston is movable relative to the housing to a maximum first position in response to pressure within the second chamber being higher than pressure within the first chamber and to a maximum second position in response to pressure within the first chamber being higher than pressure within the second chamber, comprise: (1) moving the piston to the first position by varying pressure within at least one of the first chamber and the second chamber such that pressure within the second chamber is higher than pressure within the first chamber; and (2) while the piston remains in the first position: (a) reducing pressure within the second chamber and/or increasing pressure within the first chamber; and (b) increasing pressure within the second chamber and/or decreasing pressure within the first chamber. In some methods, steps (1) and (2) are performed using a bidirectional hydraulic pump. In some methods, the hydraulically-actuated device is coupled to a BOP stack.

Some methods comprise repeating step (2). Some methods comprise: (3) moving the piston to the second position by varying pressure within at least one of the first chamber and the second chamber such that pressure within the first chamber is higher than pressure within the second chamber. Some methods comprise repeating steps (1) and (2).

Some methods comprise capturing, with one or more sensors, data indicative of one or more parameter values, including: a pressure of hydraulic fluid within the hydraulically-actuated device, a flowrate of hydraulic fluid within the hydraulically-actuated device, and/or a temperature of hydraulic fluid within the hydraulically-actuated device.

In some methods, varying, increasing, and/or reducing pressure within the first chamber and/or varying, increasing, and/or reducing pressure within the second chamber is performed by actuating a pump. In some methods, actuating the pump comprises actuating a motor that is coupled to the pump. In some methods, the motor comprises an electric motor.

In some methods, the one or more parameter values includes a speed of the pump. In some methods, the one or more parameter values includes: a speed of the motor; a torque output by the motor; and/or a power output by the motor. In some methods, the one or more parameter values includes a voltage supplied to the motor and/or a current supplied to the motor.

Some methods comprise comparing at least one of the one or more parameter values indicated in data captured by the one or more sensors to an expected parameter value. Some methods comprise determining if a difference between the parameter value indicated in data captured by the one or more sensors and the expected parameter value exceeds a threshold.

In some methods, the hydraulically-actuated device contains a hydraulic fluid. In some methods, the hydraulic fluid comprises an oil-based fluid, sea water, desalinated water, treated water, and/or water-glycol. In some methods, the hydraulic fluid comprises water-glycol.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/have/contain—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1:
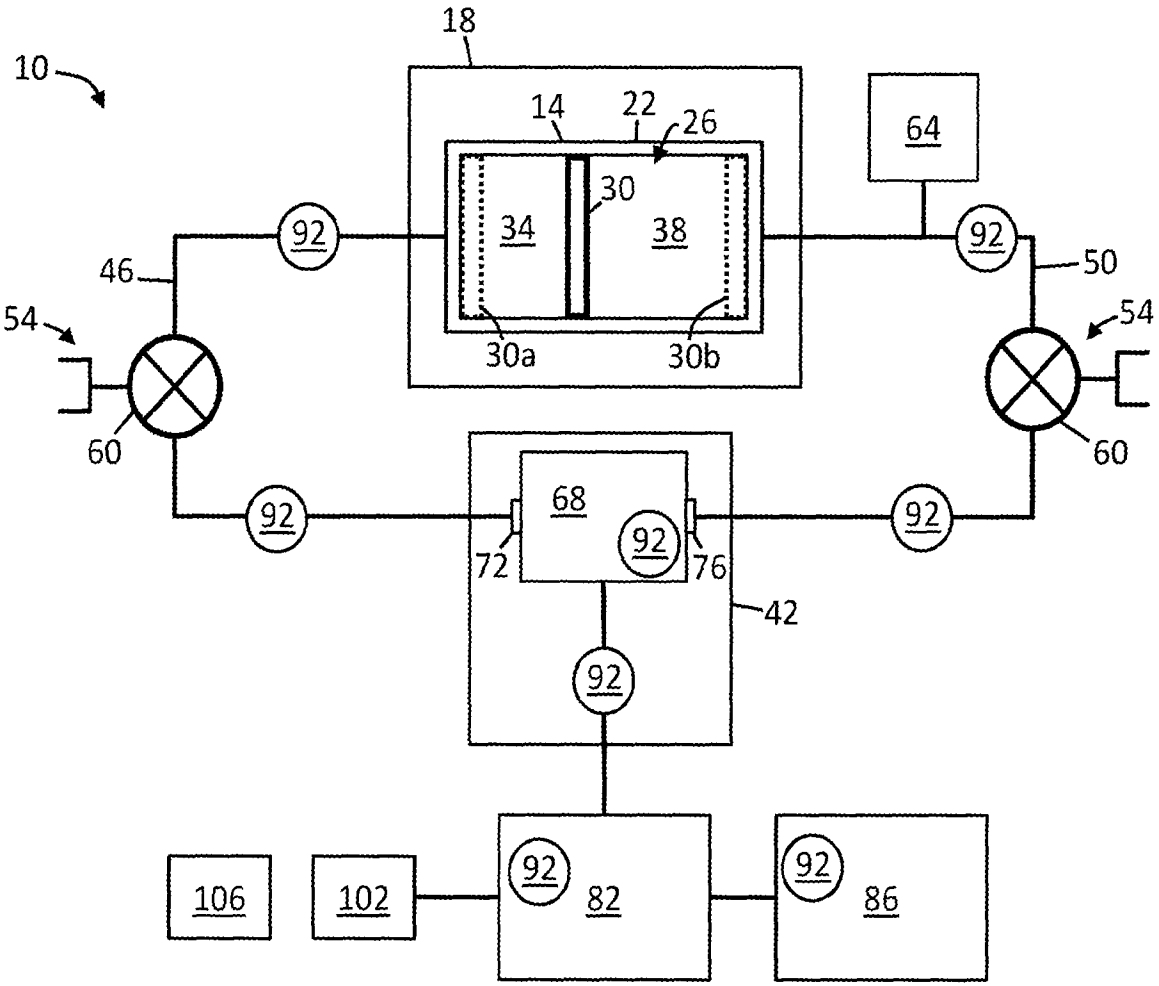
FIG. 1 is a schematic of one embodiment of the present systems.

Referring now to the drawings, and more particularly to FIG. 1, shown therein and designated by the reference numeral 10 is one embodiment of the present systems. In the embodiment shown, system 10 includes a hydraulically-actuatable device 14. In this embodiment, hydraulically-actuatable device 14 is a component of a BOP 18 (e.g., a ram- or annular-type BOP). In other embodiments, a hydraulically-actuatable device (e.g., 14) may be a component of any suitable device, such as, for example, an accumulator, test valve, failsafe valve, kill and/or choke line and/or valve, riser joint, hydraulic connector, and/or the like.

In the depicted embodiment, hydraulically-actuatable device 14 comprises a housing 22 defining an interior volume 26. As shown, hydraulically-actuatable device 14 includes a piston 30 disposed within interior volume 26 such that the piston divides the interior volume into a first chamber 34 and a second chamber 38. In this embodiment, piston 30, in response to pressures within first chamber 34 and second chamber 38, is movable relative to housing 22 between a maximum first position (e.g., shown with phantom lines 30*a*) and a maximum second position (e.g., shown with phantom lines 30*b*). For example, in the depicted embodiment, piston 30 may be moved toward the first position in response to pressure within second chamber 38 being greater than pressure within first chamber 34, and the piston may be moved toward the second position in response to pressure within the first chamber being greater than pressure within the second chamber. A piston (e.g., 30) may be in a maximum position relative to a housing (e.g., 22) when the piston is at an end-of-stroke position beyond which the piston cannot move relative to the housing (e.g., due to physical interference between the piston and the housing) or at any one of a range of positions that are proximate to the end-of-stroke position (e.g., including positions that are within 1, 2, 3, 4, 5, 6, 7, 8, 9, or 10% of the total stroke of the piston of the end-of-stroke position). In some embodiments (e.g., 10), a piston (e.g., 30) of a hydraulically-actuated device (e.g., 14) may be coupled to one or more rams of a BOP (e.g., 18) such that, for example, when the piston is in one of a maximum first position (e.g., 30*a*) and a maximum second position (e.g., 30*b*), the one or more rams are in an open position, and, when the piston is in the other of the first position and the second position, the one or more rams are in a closed position (e.g., some embodiments of the present systems may be used to close and seal a wellbore).

In the embodiment shown, system 10 includes a pressure source 42 (examples of which are provided below) configured to vary pressure within at least one of first chamber 34 and second chamber 38. To illustrate, in this embodiment, pressure source 42 is in fluid communication with first chamber 34 via a first communication path 46 and in fluid communication with second chamber 38 via a second communication path 50. Such communication path(s) (e.g., 46, 50, and/or the like) may include rigid and/or flexible conduit(s), which may be coupled to a pressure source (e.g., 42) and/or a hydraulically-actuated device (e.g., 14) in any suitable fashion, such as, for example, via stab(s), port(s), and/or the like. Hydraulic fluid for use in the present systems can comprise any suitable hydraulic fluid, such as, for example: an oil-based fluid, sea water, desalinated water, treated water, water-glycol, and/or the like.

In the depicted embodiment, system 10 includes one or more interfaces 54, each of which may include a valve 60, configured to provide control of and/or access to hydraulic fluid within system 10 from outside of the system (e.g., control of fluid communication through a communication path 46, 50, and/or the like, access to provide and/or remove hydraulic fluid to and/or from the system, and/or the like). Such interface(s) (e.g., 54) may be operable by a remotely-operated underwater vehicle. Such valve(s) (e.g., 60), whether or not a component of an interface (e.g., 54), may be used direct hydraulic fluid out of system 10 to, for example, decrease pressure within first chamber 34 and/or second chamber 38.

In the embodiment shown, system 10 comprises a fluid reservoir 64 (which may include one or more fluid reservoirs) configured to store and/or receive hydraulic fluid such that, for example, the fluid reservoir may facilitate the system in compensating for a loss of hydraulic fluid (e.g., due to leaks), an excess of hydraulic fluid, and/or the like. In some embodiments, hydraulic fluid may be directed (e.g., using one or more valves) to a fluid reservoir (e.g., 64) to decrease a pressure within a first chamber (e.g., 34) and/or a second chamber (e.g., 38) of a hydraulically-actuated device (e.g., 14). In some embodiments, a fluid reservoir (e.g., 64) may be configured to receive hydraulic fluid from an above-sea fluid source (e.g., via a rigid conduit and/or hot line). In some embodiments, a fluid reservoir (e.g., 64) may comprise an accumulator, which may facilitate a reduction in hydraulic fluid flow rate and/or pressure spikes within a system (e.g., 10) and/or provide pressurized hydraulic fluid in addition to or in lieu of pressurized hydraulic fluid provided by a pressure source (e.g., 42).

In this embodiment, pressure source 42 comprises a pump 68 (which may include one or more pumps) configured to provide hydraulic fluid to hydraulically-actuated device 14 to actuate the hydraulically-actuated device. Some hydraulically-actuated devices (e.g., 14) may, for effective and/or desirable operation, require hydraulic fluid at a flow rate of between 3 gallons per minute (gpm) and 130 gpm and at a pressure of between 500 pounds per square inch gauge (psig) and 5,000 psig. In embodiments (e.g., 10) including such a hydraulically-actuated device, a pump (e.g., 68) may be configured to output hydraulic fluid at such flow rates and pressures (e.g., the pump alone may be capable of providing hydraulic fluid at a sufficient flow rate and pressure to effectively and/or desirably operate the hydraulically-actuated device). A pump (e.g., 68) of the present systems (e.g., 10) may comprise any suitable pump, such as, for example, a positive displacement pump (e.g., a piston pump, such as, for example, an axial piston pump, radial piston pump, duplex, triplex, quintuplex, or the like piston/plunger pump, diaphragm pump, gear pump, vane pump, screw pump, gerotor pump, and/or the like), velocity pump (e.g., a centrifugal pump, and/or the like), over-center pump, switched-mode pump, unidirectional pump, bi-directional pump, and/or the like.

In the depicted embodiment, pump 68 is configured to actuate hydraulically-actuated device 14 by selectively pressurizing first chamber 34 and second chamber 38 of the hydraulically-actuated device. For example, in the embodiment shown, pump 68 comprises a bi-directional pump. To illustrate, pump 68 may include a first port 72 in fluid communication with first chamber 34 and a second port 76 in fluid communication with second chamber 38. When pump 68 is used to pressurize first chamber 34, first port 72 may be characterized as an outlet and second port 76 may be characterized as an inlet. Conversely, when pump 68 is used to pressurize second chamber 38, first port 72 may be characterized as an inlet and second port 76 may be characterized as an outlet.

More particularly, in this embodiment, pump 68 is configured such that rotation of the pump in a first direction urges fluid toward first chamber 34, thereby increasing pressure within the first chamber, and/or urges fluid away from (e.g., out of) second chamber 38, thereby decreasing pressure within the second chamber (e.g., causing piston 30 to be moved toward or maintained in the second position). Similarly, in the depicted embodiment, pump 68 is configured such that rotation of the pump in a second direction urges fluid toward second chamber 38, thereby increasing pressure within the second chamber, and/or urges fluid away from (e.g., out of) first chamber 34, thereby decreasing pressure within the first chamber (e.g., causing piston 30 to be moved toward or maintained in the first position). Some embodiments of the present systems in which a pump (e.g., 68) is not bi-directional may nevertheless be configured such that the pump can selectively pressurize a first chamber (e.g., 34) and a second chamber (e.g., 38) of a hydraulically-actuated device (e.g., via valve(s) disposed between the pump and the hydraulically-actuated device).

In the embodiment shown, system 10 comprises a motor 82 (which may include one or more motors) configured to actuate pump 68 (e.g., rotate the pump in the first and second directions). In the embodiment shown, motor 82 is electrically actuated; however, in other embodiments, a motor (e.g., 82) may be hydraulically-actuated. In embodiments (e.g., 10) comprising an electric motor (e.g., 82), the motor may comprise any suitable electric motor, such as, for example, a synchronous alternating current (AC) motor, asynchronous AC motor, brushed direct current (DC) motor, brushless DC motor, permanent magnet DC motor, and/or the like.

In this embodiment, system 10 comprises a controller 102 (which may include one or more controllers) configured to be coupled to motor 82 and to control (e.g., activate, deactivate, change or set a rotational speed of, change or set of a direction of, and/or the like) the motor. In the depicted embodiment, controller 102 comprises an electric motor speed controller, such as, for example, a variable speed drive; however, in other embodiments, a controller (e.g., 102) may comprise any suitable controller that is capable of controlling a motor.

In the embodiment shown, system 10 comprises a battery 86 (which may include one or more batteries). In this embodiment, battery 86 is configured to provide electrical power to motor 82. In some embodiments (e.g., 10), a battery (e.g., 86) may be configured to provide electrical power to a motor (e.g., 82) sufficient to actuate a hydraulically-actuated device (e.g., 14) using a pump (e.g., 68) coupled to the motor, without requiring electrical power from an above-sea power source. A battery (e.g., 86) of the present systems (e.g., 10) can comprise any suitable battery, such as, for example, a lithium-ion battery, nickel-metal hydride battery, nickel-cadmium battery, lead-acid battery, and/or the like. A battery (e.g., 86) may be less susceptible to effectiveness losses at increased pressures than other energy storage devices (e.g., accumulators). A battery (e.g., 86) may also occupy a smaller volume and/or have a lower weight than other energy storage devices (e.g., accumulators). Thus, batteries may be efficiently adapted to provide at least a portion of an energy necessary to, for example, perform emergency functions associated with a BOP (e.g., autoshear functions, deadman functions, and/or the like).

In the depicted embodiment, system 10 includes one or more sensors 92. Sensor(s) (e.g., 92) of the present systems (e.g., 10) can comprise any suitable sensor, such as, for example, a pressure sensor (e.g., a piezoelectric pressure sensor, strain gauge, and/or the like), flow sensor (e.g., a turbine, ultrasonic, Coriolis, and/or the like flow sensor, a flow sensor configured to determine or approximate a flow rate based, at least in part, on data indicative of pressure, and/or the like), temperature sensor (e.g., a thermocouple, resistance temperature detector, and/or the like), position sensor (e.g., a Hall effect sensor, potentiometer, and/or the like), proximity sensor, acoustic sensor, and/or the like. By way of example, in the embodiment shown, sensor(s) 92 may be configured to capture data indicative of parameters such as pressure, flow rate, temperature, and/or the like of hydraulic fluid within system 10 (e.g., within pump 68, hydraulically-actuated device 14, first communication path 46, second communication path 50, fluid reservoir 64, and/or the like), a position, velocity, and/or acceleration of piston 30 relative to housing 22, a (e.g., rotational) speed of motor 82 and/or the pump, a torque output by the motor, a voltage supplied to the motor (e.g., by battery 86), a current supplied to the motor (e.g., by the battery), and/or the like. Data captured by sensor(s) 92 may be transmitted to controller 102, processor 106, an above-sea interface, and/or the like. In some embodiments, a system (e.g., 10) may include a memory configured to store data captured by sensor(s) (e.g., 92).

In this embodiment, system 10 includes a processor 106 configured to control pump 68 to move piston 30 relative to housing 22. For example, in the depicted embodiment, processor 106 may transmit commands to controller 102 to actuate motor 82 to rotate pump 68 (e.g., in the first direction), thereby increasing pressure within first chamber 34 and/or decreasing pressure within second chamber 38 and causing piston 30 to move toward or be maintained in the second position. Similarly, processor 106 may transmit commands to controller 102 to actuate motor 82 to rotate pump 68 (e.g., in the second direction), thereby increasing pressure within second chamber 38 and/or decreasing pressure within first chamber 34 and causing piston 30 to move toward or be maintained in the first position. In the depicted embodiment, control of pump 68 by processor 106 may be facilitated by data captured by sensor(s) 92. For example, processor 106 may receive data captured by sensor(s) 92 and adjust a speed and/or direction of pump 68 until a speed and/or direction of the pump, a hydraulic fluid flow rate and/or pressure within system 10, a position of piston 30 relative to housing 22, and/or the like, as indicated in data captured by the sensor(s), meets a target value. In some embodiments, a processor (e.g., 106) may be configured to communicate with an above-sea interface, to, for example, send and/or receive data, commands, signals, and/or the like. In some embodiments, function(s) described herein for a processor (e.g., 106) may be performed by a controller (e.g., 102) and/or function(s) described herein for a controller (e.g., 102) may be performed by a processor (e.g., 106). In some embodiments, a processor (e.g., 106) and a controller (e.g., 102) may be the same component. As used herein, "processor" encompasses a programmable logic controller.

In a system (e.g., 10) where a hydraulically-actuated device (e.g., 14) is a component of a BOP (e.g., 18), the system may be configured to function as a safety and/or back-up blowout prevention system. For example, a processor (e.g., 106) of the system may be configured to actuate the hydraulically-actuated device to close the wellbore in response to a command received from an above-sea interface (e.g., via a dedicated communication channel, acoustic interface, and/or the like), a signal from a traditional autoshear, deadman, and/or the like system, and/or the like. For further example, the system may have sensor(s) (e.g., 92) including a sensor (e.g., a proximity sensor, such as, for example, an electromagnetic-, light-, or sound-based proximity sensor) configured to detect disconnection of the lower marine riser package from the BOP stack, and the processor, based at least in part on data captured by the sensor, may actuate the hydraulically-actuated device to close the wellbore. For yet further example, the processor may be configured to detect a loss of communication with the surface, upon which the processor may actuate the hydraulically-actuated device to close the wellbore.

Figure 2:
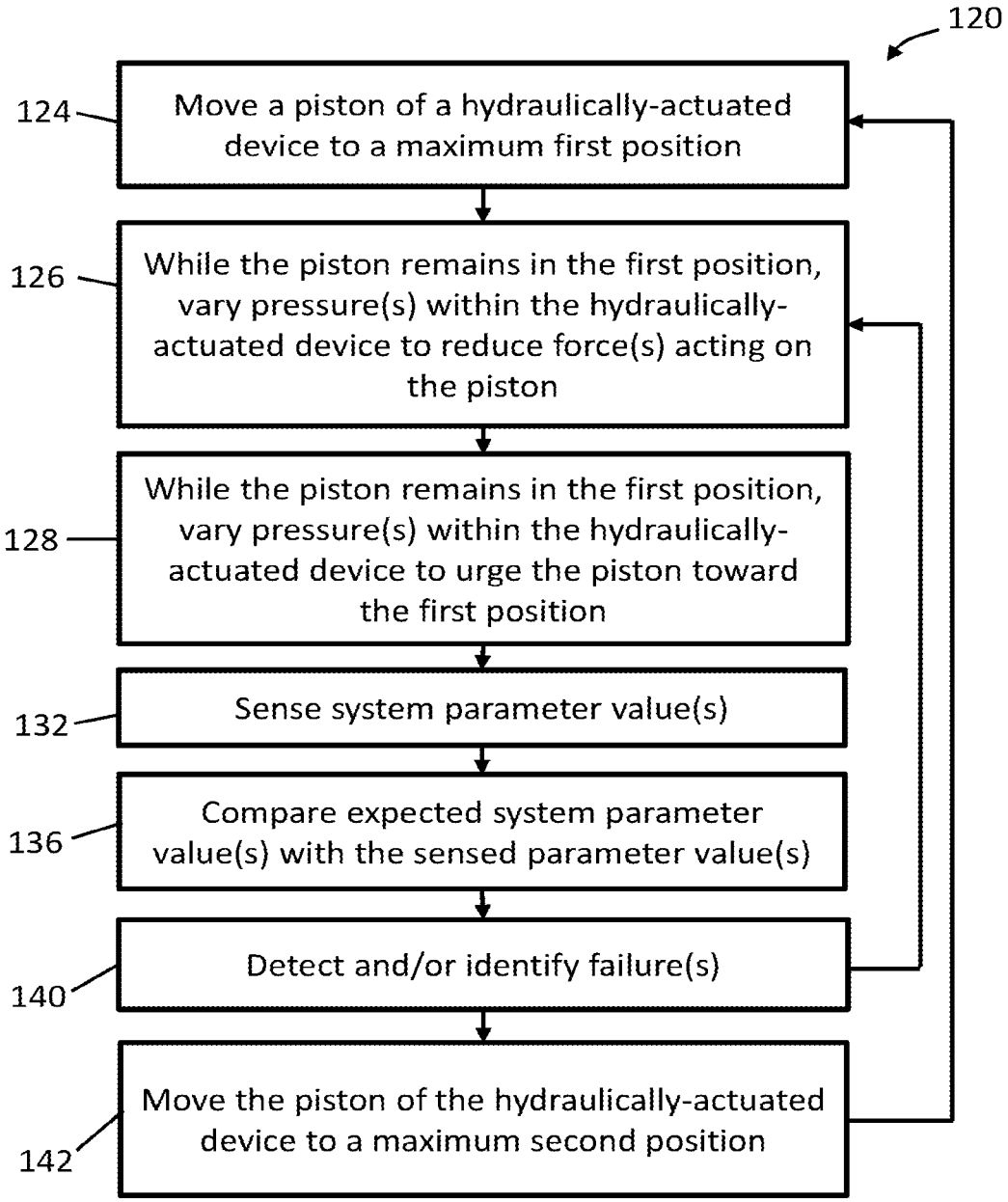
FIG. 2 depicts embodiments of the present methods for assessing the reliability of a hydraulically-actuated device, which may be implemented using the system of FIG. 1.

Referring now to FIG. 2, shown is an embodiment 120 of the present methods for assessing the reliability of a hydraulically-actuated device (e.g., 14). In the embodiment shown, at step 124, a piston (e.g., 30) of a hydraulically-actuated device (e.g., 14) can be moved to a maximum first position (e.g., 30*a*). If the piston is already in the first position prior to step 124, step 124 may be omitted. To illustrate, in system 10, pump 68 can be actuated to increase pressure within second chamber 38 and/or decrease pressure within first chamber 34, thereby moving piston 30 to the first position.

At step 126, in this embodiment, while the piston remains in the first position, pressure(s) within the hydraulically-actuated device can be varied to reduce force(s) acting on the piston. In system 10, to illustrate, pump 68 can be actuated to decrease pressure within second chamber 38 and/or increase pressure within first chamber 34 (e.g., thereby reducing a pressure differential between the first and second chambers). In the depicted embodiment, at step 128, while the piston remains in the first position, pressure(s) within the hydraulically-actuated device can be varied to urge, but not necessarily move, the piston toward the first position (e.g., the pressure(s) can be varied to generate or increase a force exerted on the piston in a direction from a maximum second position 30*b* toward the first position). To illustrate, in system 10, pump 68 can be actuated to increase pressure within second chamber 38 and/or decrease pressure within first chamber 34 (e.g., thereby increasing a pressure differential between the first and second chambers).

Step 128 may be performed such that a pressure within the hydraulically-actuated device (e.g., within second chamber 38) meets a threshold or target pressure, such as, for example, a maximum operating pressure of the hydraulically-actuated device (e.g., 3,000, 4,000, 5,000, or more psig for many ram-type BOPs). During step 128, once a pressure within the hydraulically-actuated device meets the threshold or target pressure, the hydraulically-actuated device may be isolated from a pressure source (e.g., pump 68), as in, for example, a pressure decay test, and/or the pressure source may be actuated to maintain the pressure within the hydraulically-actuated device at or proximate to the threshold or target pressure (e.g., using feedback from sensor(s) 92), as in, for example, a maintained pressure test. Step 128 may be performed for a (e.g., predetermined) period of time, such as, for example, 15, 30, 45, or more seconds, 1, 2, 5, 10, 15, 20, 25, 30, or more minutes, and/or the like. Such a period of time may be selected based on, for example, a calculated or approximated period of time necessary to detect a (e.g., maximum acceptable) leak within the hydraulically-actuated device or a system (e.g., 10) associated therewith, which may be determined considering, for example, system components (e.g., a resolution of sensor(s) 92, controller 102, and/or the like), a hydraulic analysis of the system, and/or the like.

In the embodiment shown, steps 132, 136, and/or 140 may be performed concurrently with step 128. At step 132, in this embodiment, system (e.g., 10) parameter value(s) can be sensed (e.g., using sensor(s) 92). Such parameter(s) can be any suitable parameter(s), including any one or more of those described above with respect to sensor(s) 92. In the depicted embodiment, at steps 136 and 140, the sensed parameter value(s) can be compared to expected parameter value(s) to detect and/or identify fault(s). In method 120, such fault(s) may be communicated (e.g., by processor 106) to an above-sea interface.

To illustrate, in system 10, processor 106 may compare sensed parameter value(s) to corresponding expected parameter value(s), such as for example, a known, minimum, maximum, calculated, commanded, and/or historical pressure, flow rate, temperature, and/or the like of hydraulic fluid within system 10, position, velocity, and/or acceleration of piston 30 relative to housing 22, speed of motor 82 and/or pump 68, torque output by the motor, voltage and/or current supplied to the motor, and/or the like. Processor 106 may be configured to detect and/or identify a fault if, for example, difference(s) between sensed and expected parameter value(s) exceed a threshold (e.g., the sensed and expected parameter value(s) differ by 1, 5, 10, 15, 20% or more), a time rate of change of a sensed parameter value is below or exceeds a threshold, a sensed parameter value is below a minimum expected parameter value or exceeds a maximum expected parameter value, and/or the like.

For example, and particularly when implementing a pressure-decay test, processor 106 may compare a sensed pressure within system 10 (e.g., within pump 68, hydraulically-actuated device 14, first communication path 46, second communication path 50, fluid reservoir 64, and/or the like) to an expected pressure within the system, and/or the like, and, if difference(s) between the sensed value(s) and the expected value(s) exceed a threshold, a fault, such as a leak within the system, may be detected and/or identified. For further example, and particularly when implementing a maintained pressure test, processor 106 may compare a sensed speed of motor 82 and/or pump 68 to an expected speed of the motor and/or pump, a sensed voltage and/or current supplied to the motor to an expected voltage and/or current supplied to the motor, and/or the like, and, if difference(s) between the sensed value(s) and the expected value(s) exceed a threshold, a fault, such a leak within the system, may be detected or identified. For yet further example, processor 106 may be configured to compare a sensed voltage and/or current supplied by battery 86 to an expected voltage and/or current supplied by the battery, and, if difference(s) between the sensed value(s) and the expected value(s) exceed a threshold, a fault, such as a fault associated with the battery, may be detected or identified (e.g., as in a battery load test).

In the depicted embodiment, steps 126-140 can be repeated any suitable number of times, and such repetition can occur at any suitable interval (e.g., 2, 4, 6, 8, 10, 12, or more hours, 1, 2, 3, 4, 5, 6, 7, 8, 9, 10, or more days, and/or the like). In these ways and others, method 120, and particularly steps 126-140, may provide for testing of a system (e.g., 10), without requiring full actuation of a hydraulically-actuated device (e.g., 14) (e.g., movement of a piston 30 to each of a maximum first position 30*a* and a maximum second position 30*b*). For example, in a system (e.g., 10) where a hydraulically-actuated device (e.g., 14) is a component of a BOP (e.g., 18), method 120, and particularly steps 126-140, may provide for testing of the system without requiring closing of the BOP.

At step 142, in the embodiment shown, the piston of the hydraulically-actuated device can be moved to a maximum second position (e.g., 30*b*). To illustrate, in system 10, pump 68 can be actuated to increase pressure within first chamber 34 and/or decrease pressure within second chamber 38, thereby moving piston 30 to the second position. During step 142, system parameter value(s) can be sensed, compared to expected system parameter value(s), and fault(s) can be identified and/or detected in a same or substantially similar fashion to as described above for steps 132, 136, and 140. In this embodiment, method 120 can be repeated any suitable number of times, and such repetition can occur at any suitable interval (e.g., 1, 2, 3, 4, 5, 6, 7, 8, 9, 10, 15, 20, 25, 30, or more days, and/or the like). Method 120 may be performed manually (e.g., via commands from an above-sea interface) and/or automatically (e.g., implemented via processor 106). For example, in some embodiments, steps 126-140 may be performed automatically, and step 142 may be performed manually.

Figure 3:
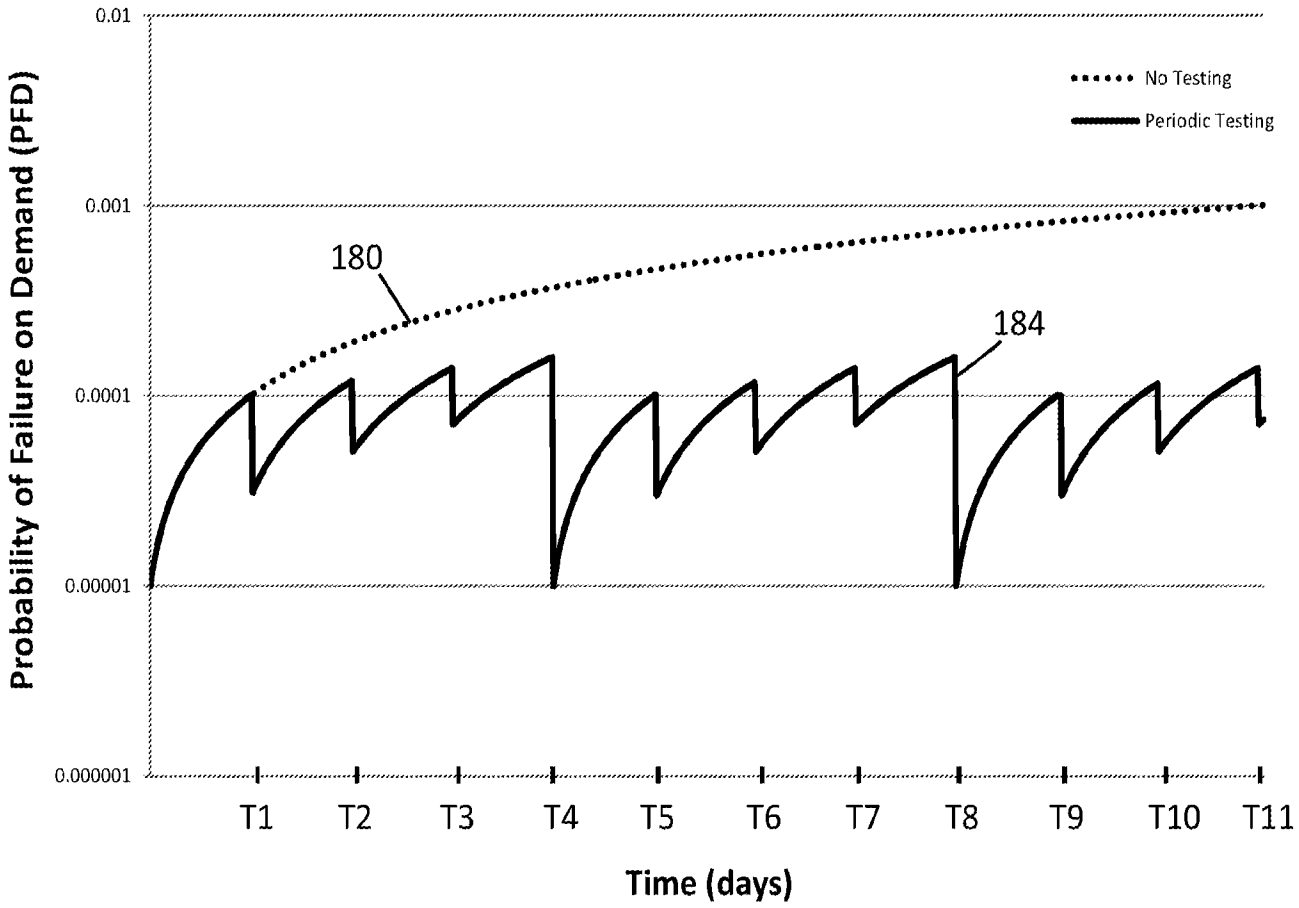
FIG. 3 is a graphical representation of PFD versus time for a system, such as the system of FIG. 1, with and without implementing embodiments of the present methods, such as the methods of FIG. 2.

FIG. 3 is a graphical representation of PFD versus time for a system (e.g., 10), with and without implementing embodiments (e.g., 120) of the present methods. Curve 180 represents PFD of system 10 without implementing embodiments (e.g., 120) of the present methods. As shown, the PFD increases over time due to, for example, growing uncertainty regarding the operability of system 10. Curve 184 represents PFD of system 10 with implementing embodiments (e.g., 120) of the present methods. Reductions in the PFD at times T1, T2, T3 can be attributed, at least in part, to steps 126-140 of method 120, and the reduction in the PFD at time T4 can be attributed, at least in part, to step 142.

Figure 5:
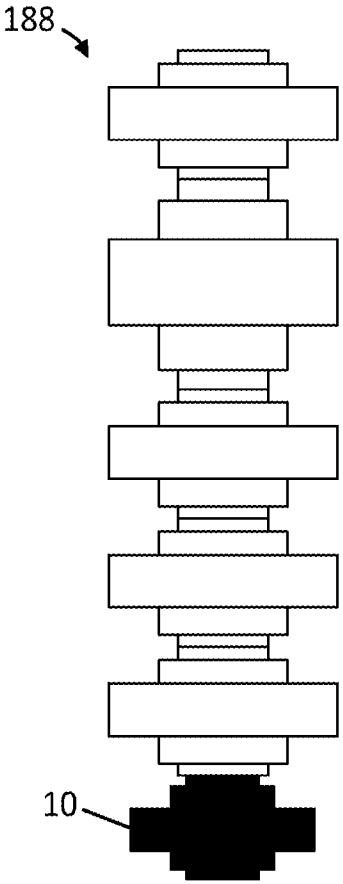
FIGS. 4 and 5 are schematics of a BOP stack including one embodiment of the present systems coupled to the BOP stack in a first position and a second position, respectively.
Figure 4:
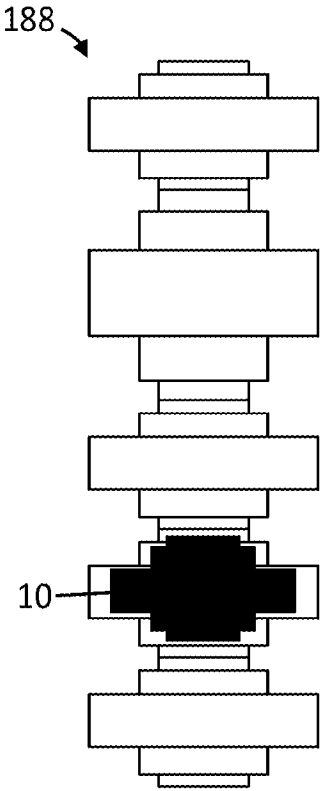

As shown in FIGS. 4 and 5, system 10 may be integrated with an existing BOP stack 188, in some instances, without affecting the operation of other systems of the BOP stack. Provided for illustrative purposes, FIG. 4 depicts such a configuration in which system 10 replaces an existing BOP of BOP stack 188, and FIG. 5 depicts a configuration in which system 10 is coupled to a wellhead end of BOP stack 188.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus-or step-plus-function limitations, unless such a limitation is explicitly recited in a given claim using the phrase(s) "means for" or "step for," respectively.

The invention claimed is:

1. A method for testing a hydraulically-actuated device having a housing defining an interior volume and a piston disposed within the interior volume such that the piston divides the interior volume into a first chamber and a second chamber, where the piston is movable relative to the housing to a maximum first position in response to pressure within the second chamber being higher than pressure within the first chamber and to a maximum second position in response to pressure within the first chamber being higher than pressure within the second chamber, the method comprising steps:

(1) moving the piston from the maximum first position to the maximum second position by varying pressure within at least one of the first chamber or the second chamber such that pressure within the first chamber is higher than pressure within the second chamber;

(2) measuring at least one parameter associated with the pressure within the first or second chamber during a predetermined period of time while the piston is moving from the maximum first position to the maximum second position, comparing the at least one parameter to an expected parameter value, and determining if a difference between the at least one parameter and the expected parameter value exceeds a threshold to detect a leak within the hydraulically-actuated device or a system associated therewith; and (3) calculating a probability of failure (PFD) versus time for the hydraulically-actuated device or the system associated therewith.

2. The method of claim 1, where the hydraulically-actuated device contains a hydraulic fluid and wherein the at least one parameter includes at least one of:

a pressure of the hydraulic fluid within the hydraulically-actuated device;

a flowrate of the hydraulic fluid within the hydraulically-actuated device; or a temperature of the hydraulic fluid within the hydraulically-actuated device.

3. The method of claim 1, wherein the moving the piston is performed by actuating a pump.

4. The method of claim 3, wherein the actuating the pump includes actuating a motor that is coupled to the pump, the motor being an electric motor, and the at least one parameter includes at least one of:

a speed of the pump;

a speed of the motor;

a torque output by the motor;

a voltage supplied to the motor;

a current supplied to the motor; or a power output by the motor.

5. The method of claim 1, where the hydraulically-actuated device contains a hydraulic fluid and the hydraulically-actuated device is coupled to a blowout preventer (BOP) stack, and the hydraulic fluid includes at least one of an oil-based fluid, sea water, desalinated water, treated water, or water-glycol.

6. The method of claim 1, where the hydraulically-actuated device contains a hydraulic fluid, the method further comprising:

transferring the hydraulic fluid at least one of to or from the hydraulically-actuated device via an access port fluidically coupled to a remotely-operated underwater vehicle (ROV).

7. The method of claim 1, wherein the hydraulically-actuated device is a component of blowout preventer (BOP).

8. The method of claim 1, wherein a maximum pressure in the first chamber is selected to be at a target pressure.

9. The method of claim 8, wherein the target pressure is about a maximum operating pressure of the hydraulically-actuated device.

10. The method of claim 9, wherein the maximum operating pressure is in a range of 3000-5000 psig.

11. A method for testing a hydraulically-actuated device having a housing defining an interior volume and a piston disposed within the interior volume such that the piston divides the interior volume into a first chamber and a second chamber, where the piston is movable relative to the housing to a maximum first position in response to pressure within the second chamber being higher than pressure within the first chamber and to a maximum second position in response to pressure within the first chamber being higher than pressure within the second chamber, the method comprising steps:

(1) moving the piston to the maximum first position by varying pressure within at least one of the first chamber or the second chamber such that pressure within the second chamber is higher than pressure within the first chamber;

(2) while the piston remains in the maximum first position, increasing pressure within the second chamber and/or decreasing pressure within the first chamber to meet a target pressure differential for a predetermined period of time;

(3) measuring at least one first parameter associated with the pressure within the second chamber during the period of time to detect a leak within the hydraulically-actuated device or a system associated therewith;

(4) moving the piston to the maximum second position by varying pressure within at least one of the first chamber or the second chamber such that pressure within the second chamber is lower than pressure within the first chamber;

(5) while the piston remains in the maximum second position, increasing pressure within the first chamber and/or decreasing pressure within the second chamber to meet a target pressure differential for a predetermined period of time; and (6) measuring at least one second parameter associated with the pressure within the first chamber during the period of time to detect a leak within the hydraulically-actuated device or a system associated therewith.

12. The method of claim 11, further comprising: calculating a probability of failure (PFD) versus time for the hydraulically-actuated device or the system associated therewith, and wherein a time elapsed between testing the hydraulically-actuated device is selected such that PFD is at about or lower than a target value.

13. The method of claim 11, wherein a maximum pressure in the first chamber is selected to be at a maximum operating pressure of the hydraulically-actuated device.

14. The method of claim 11, wherein a maximum pressure in the second chamber is selected to be at a maximum operating pressure of the hydraulically-actuated device.

15. The method of claim 11, further comprising isolating the hydraulically-actuated device from a pressure source once the target pressure differential is met in one of step (3) or step (6).

16. A system comprising:

a hydraulically-actuated device including:

a housing defining an interior volume; and a piston disposed within the interior volume such that the piston divides the interior volume into a first chamber and a second chamber;

where the piston is movable relative to the housing to a maximum first position in response to pressure within the second chamber being greater than pressure within the first chamber and to a maximum second position in response to pressure within the first chamber being greater than pressure within the second chamber;

a hydraulic pump configured to vary pressure within at least one of the first chamber or the second chamber; and a processor configured to control the hydraulic pump, while the piston is moving from the maximum first position in response to pressure within the second chamber being smaller than pressure within the first chamber, the processor further configured to obtain at least one parameter measured by a sensor operably coupled to the hydraulically-actuated device, the processor further configured to compare the at least one parameter to an expected parameter value, and determine if a difference between the at least one parameter and the expected parameter value exceeds a threshold to detect a leak within the hydraulically-actuated device or a system associated therewith, the processor being further configured to calculate a probability of failure (PFD) versus time for the hydraulically-actuated device or the system associated therewith.

17. The system of claim 16, configured such that:

rotating the hydraulic pump in a first direction at least one of decreases pressure within the second chamber or increases pressure within the first chamber; and rotating the hydraulic pump in a second direction that is opposite the first direction at least one of increases pressure within the second chamber or decreases pressure within the first chamber.

18. The system of claim 16, further comprising:

a reservoir in fluid communication with the hydraulic pump; and a remotely-operated underwater vehicle (ROV) interface in fluid communication with the hydraulically-actuated device, the hydraulically-actuated device including a blowout preventer (BOP).

19. The system of claim 16, further comprising an accumulator disposed between the bidirectional hydraulic pump and the hydraulically-actuated device, the accumulator being configured to provide pressurized hydraulic fluid to the hydraulically-actuated device to vary pressure within at least one of the first chamber or the second chamber.

* * * * *